US008259142B2

(12) United States Patent
Hirota et al.

(10) Patent No.: US 8,259,142 B2
(45) Date of Patent: Sep. 4, 2012

(54) IMAGE FORMING APPARATUS WITH DEVELOPER PASSAGE AMOUNT CONTROL ELECTRODES

(75) Inventors: Tetsuro Hirota, Hadano (JP); Masanori Horike, Yokohama (JP); Nobuaki Kondoh, Yokohama (JP); Osamu Endou, Yokohama (JP); Shin Kayahara, Kamakura (JP); Tomoko Takahashi, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 374 days.

(21) Appl. No.: 12/707,124

(22) Filed: Feb. 17, 2010

(65) Prior Publication Data

US 2010/0214364 A1 Aug. 26, 2010

(30) Foreign Application Priority Data

Feb. 25, 2009 (JP) ..... 2009-042846

(51) Int. Cl.
*B41J 2/00* (2006.01)

(52) U.S. Cl. ..... 347/151

(58) Field of Classification Search ..... 347/151, 347/55, 43, 111, 112, 115, 139, 148; 399/168, 399/223, 235, 236, 241, 291, 293, 295–298, 399/302, 310

See application file for complete search history.

(56) References Cited

U.S. PATENT DOCUMENTS 5,818,490 A * 10/1998 Larson ..... 347/151
5,867,190 A * 2/1999 Kagayama ..... 347/55
5,955,228 A 9/1999 Sakai et al.
6,091,435 A * 7/2000 Onda et al. ..... 347/151
6,597,884 B2 7/2003 Miyaguchi et al.
6,643,486 B1 11/2003 Endoh et al.
6,708,014 B2 3/2004 Miyaguchi et al.
6,721,534 B2 4/2004 Takahashi
6,775,506 B2 8/2004 Endoh et al.
6,795,674 B2 9/2004 Endoh et al.
6,901,231 B1 5/2005 Sakai et al.
6,941,098 B2 9/2005 Miyaguchi et al.
6,947,691 B2 9/2005 Miyaguchi et al.
7,024,142 B2 4/2006 Sakai et al.
7,062,204 B2 6/2006 Miyaguchi et al.
7,123,864 B2 10/2006 Miyaguchi et al.
7,187,892 B2 3/2007 Horike et al.

(Continued)

FOREIGN PATENT DOCUMENTS

JP 59-181370 10/1984

(Continued)

*Primary Examiner* — Kristal Feggins

(74) *Attorney, Agent, or Firm* — Oblon, Spivak, McClelland, Maier & Neustadt, L.L.P.

(57) ABSTRACT

An image forming apparatus comprises a toner-bearing member that bears toner and makes the toner clouded thereon. A toner passage control device including plural widthwise lines of toner passage holes in a printing medium conveyance direction is provided. Each of the toner passage holes includes a control electrode that controls passage of the toner through each of the toner passage holes toward a printing medium. a control pulse proving device provides a control pulse to the control electrode to operate. The control pulse applied to the control electrode of the one of the plural lines is different from that applied to the control electrode of the other one of the plural lines.

6 Claims, 13 Drawing Sheets

U.S. PATENT DOCUMENTS

| | | | |
|---|---|---|---|
| 7,200,352 | B2 | 4/2007 | Sakai et al. |
| 7,236,720 | B2 | 6/2007 | Nakazato et al. |
| 7,308,222 | B2 | 12/2007 | Nakagawa et al. |
| 7,526,238 | B2 | 4/2009 | Yamada et al. |
| 2004/0208674 | A1 | 10/2004 | Ilo et al. |
| 2006/0251449 | A1 | 11/2006 | Takahashi et al. |
| 2009/0257786 | A1 | 10/2009 | Nakagawa et al. |

FOREIGN PATENT DOCUMENTS

| | | |
|---|---|---|
| JP | 63-136058 | 6/1988 |
| JP | 2-52260 | 2/1990 |
| JP | 2-226261 | 9/1990 |
| JP | 2933930 | 5/1999 |
| JP | 2009-42500 | 2/2009 |

* cited by examiner

PULSE WIDTH TABLE

| LINE | PULSE WIDTH DATA |
|---|---|
| 1 | 256 |
| 2 | 230 |
| 3 | 205 |
| 4 | 177 |
| 5 | 177 |
| 6 | 205 |
| 7 | 230 |
| 8 | 256 |

PULSE WIDTH TABLE

| | PULSE WIDTH DATA | |
|---|---|---|
| LINE | LINE SPEED 168mm/g | 84mm/g |
| 1 | 256 (69%) | 492 (72%) |
| 2 | 230 (77%) | 448 (79%) |
| 3 | 205 (86%) | 402 (88%) |
| 4 | 177 (1) | 354 (1) |
| 5 | 177 | 354 |
| 6 | 205 | 402 |
| 7 | 230 | 448 |
| 8 | 256 | 492 |

WAVE HEIGHT VALUE TABLE

| LINE | WAVE HEIGHT VALUE DATA |
|---|---|
| 1 | 256 |
| 2 | 230 |
| 3 | 205 |
| 4 | 177 |
| 5 | 177 |
| 6 | 205 |
| 7 | 230 |
| 8 | 256 |

| | WAVE HEIGHT VALUE DATA | |
|---|---|---|
| LINE | LINE SPEED 168mm/s | 84mm/s |
| 1 | 256 | 492 |
| 2 | 230 | 448 |
| 3 | 205 | 402 |
| 4 | 177 | 354 |
| 5 | 177 | 354 |
| 6 | 205 | 402 |
| 7 | 230 | 448 |
| 8 | 256 | 492 |

IMAGE FORMING APPARATUS WITH DEVELOPER PASSAGE AMOUNT CONTROL ELECTRODES

CROSS REFERENCE TO RELATED APPLICATION

This application claims priority under 35 USC §119 to Japanese Patent Application No. 2009-42846, filed on Feb. 25, 2009, the entire contents of which are herein incorporated by reference.

BACKGROUND OF THE INVENTION

1. Field of the Invention

The present invention relates to an image forming apparatus, in particular, to that capable of forming an image on a printing medium by causing toner to soar and adhere to the printing medium from a toner bearing member via toner passage holes which are controlled to be open and close.

2. Discussion of the Background Art

As a conventional image forming apparatus, a toner jet, direct toning, and toner projection system or the like of that directly prints an image on a printing medium or an inter mediate transfer medium with toner is well known.

For example, the Japanese Patent Application Laid Open No. 63-136058 discloses a technology in that electric charge generated by friction caused between a fixed blade and a rotation roller is provided to toner, which is supplied from a toner hopper. The toner is then rotationally conveyed and is controlled to soar by a control pulse applied to a control member in an electric field that is created by the rotation roller.

The toner with electric charge electro-statically adheres to the surface of the rotation roller, and thus, needs to be separated by the control pulse. Since there exists a gap of more than 100 micrometer between the rotation roller and the control member, the control pulse necessarily needs a high voltage of more than 500V to execute the separation. Thus, a driver for control use needed corresponding to a number of pixels becomes extraordinary costly. Further, a responsibility becomes deteriorated and delayed due to necessity of separating and causing the toner to soar from the rotation roller.

The Japanese Patent Registration No. 2,933,930 and the Japanese Patent Publication No. 2-52, 260 disclose a technology in that a control pulse is inputted to a control electrode where developer passes while applying an alternating bias between a rotation developer bearing member and a control device.

With this system, the above-mentioned responsibility problem is decreased. However, since an alternating electric field is uniformly entirely provided to a toner soaring region, the developer repeatedly adheres and soars from and to the developer bearing member. Thus, the alternating bias need be intensive to separate the developer adhering to the developer bearing member. Thus, a lot of separated toner swiftly soars to the control device and unavoidably adheres to the electrode of the control device, and thereby reliability decreases. Further, the high voltage of more than 500V need be applied between the developer bearing member and the control device, because a gap exists therebetween. Thus, the control pulse that causes the electric field either to allow or prohibit passage of toner in the electric field similarly needs a high voltage. Thus, the driver cost problem is yet unsolved.

The Japanese Patent Application Laid Open No. 59-181370 discloses that a developer bearing member includes plural electrodes and creates electric fields that change between the plural electrodes as time elapses, so that toner soars toward a control electrode.

Since the toner soaring and floating in the vicinity of the control electrode is controlled, the problem of increase of the control voltage existing in the above-mentioned Japanese Patent Application Laid Open No. 63-136058, the Japanese Patent Registration No. 2933930, and the Japanese Patent Publication No. 2-52260 is resolved.

As in the Japanese Patent Application Laid Open No. 59-181370, the Japanese Patent Application Laid Open No. 02-226261 discloses a technology in that a developer bearing member includes plural electrodes and creates electric fields that change as time elapses between these plural electrodes, so that toner soars. However, a control electrode that controls passage of the toner conventionally arranged on the printing medium side is arranged on a toner supplying surface side.

In this system, the control voltage can be decreased from the conventional 400V down to 100V. Further, when toner adhering to a printing head where the control electrodes are arranged is removed, the toner can be collected in a toner supply source.

For example, as shown in FIG. 23, a conventional direct printing system includes a toner bearing roller 1501 arranged as an agent bearer with its axis being extended left and right in the drawing and bears toner T having been charged thereon while driven rotated by a drive device, not shown. Below the toner bearing roller 1501, a flexible print baseboard (FPC) 1503 is arranged as a hole formation member having plural holes 1502. The FPC 1503 includes plural ring state soar electrodes 1504 surrounding the plural holes 1502 respectively while opposing the toner bearing roller 1501.

Below the FPC 1503, an opposing electrode 1506 is arranged opposing the toner bearing roller 1501. Also arranged is a printing sheet 507 conveyed above the opposing electrode 1506 by a conveyance device. Even only one hole 1502 and such a soar electrode 1504 are illustrated there, these plural combinations are practically formed on the FPC 1503. Specifically, a FPC 1503 for 600 dpi use includes 4960 items of these combinations.

The toner bearing roller 1501 is grounded, for example, and bears toner T charged in a negative polarity. When a soar voltage of the positive polarity is applied to the soar electrode 1504, the toner T on the toner bearing roller 1501 opposing the soar electrode 1504 or that in the vicinity thereof are subjected to an electric field having a prescribed intensity. Due to influence of the electric field, an electrostatic force applied to the toner T exceeds an attraction force attracting the toner T to the toner bearing roller 1501. Thus, aggregation of toner T selectively soars and enters the hole 1502 in a dot state from the loner bearing roller 1501.

Then, the toner T is drawn by an electric field created between the soar electrode 1504 and the above-mentioned intensively charged opposing electrode 1506 and keeps soaring and attracts the toner to the surface of the printing sheet 1507 via the hole 1502, so that the aggregation of the toner T becomes a dot image.

In such a situation, a soar voltage applied to each of the soar electrodes 1504 needs to be controlled to turn on and off independently by a different private use IC. Specifically, when the voltage is high, the image forming apparatus of the direct printing system needs the same number of expensive ICs as the soar electrodes 1504. For example, the FPC 3 for 600 dpi use is employed, 4960 items of expensive switching elements are needed. In general, as voltage endurance increases, an IC becomes expensive due to increase of a chip area. Thus, it is significant for the image forming apparatus of the direct printing system to decrease the control voltage in view of cost.

However, an attraction force attracting each other is created between the toner T and the toner bearing roller 1501 by a mirror image force, a van der Waals force, a liquid cross-link force or the like, and makes the soar voltage difficult to decrease. As a result, the soar voltage of more than 500 v needs to be applied in the above-mentioned apparatus.

However, the voltage applied to the soar electrode can be decreased if the developer bearer includes plural electrodes and a timely changing electric field is created between these electrodes so that toner is made in a cloud state and soars toward the control electrode as described in the Japanese Patent Application Laid Open No. 59-181370.

However, since the toner bearing roller bears the toner with charge on its surface while being driven rotated by a drive device, it necessarily has a prescribed curvature on its surface. Since the control electrode is substantially planer, a space distance between the toner bearing roller and the control electrode is different per line of the electrodes. Owing to this, it is revealed that an amount of the toner passing through a hole on a line of the electrode far distanced from the toner bearing roller is less than that of the other line distanced closer. Further, such tendency becomes prominent in a low voltage applied region. In any event, an amount of toner passing through a toner passage hole need to be highly precisely controlled to achieve high speed and high quality image formation.

SUMMARY OF THE INVENTION

The present invention has been made in view of the above noted and another problems and one object of the present invention is to provide a new and noble image forming apparatus. Such an image forming apparatus comprises a toner-bearing member that bears toner and makes the toner clouded thereon. A toner passage control device including plural widthwise lines of toner passage holes in a printing medium electrode direction is provided. Each of the toner passage holes includes a control electrode that controls passage of the toner through each of the toner passage holes toward a printing medium. a control pulse proving device provides a control pulse to the control electrode to operate. The control pulse applied to the control electrode of the one of the plural lines is different from that applied to the control electrode of the other one of the plural lines.

In another aspect, the control pulse is different from the other by including at least one of a different pulse width and a different pulse wave height.

In yet another aspect, the control pulse corresponds to a printing line speed.

In yet another aspect, the printing medium includes a printing sheet. A sheet opposing electrode is arranged on a backside of the printing sheet to receive a bias directing toward the printing sheet.

In yet another aspect, the printing medium includes an intermediate transfer medium. A medium opposing electrode is arranged on a backside of the intermediate transfer medium to receive a bias directing toward the intermediate transfer medium.

In yet another aspect, a color image formation device is provided to form a color image on the printing medium.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENTS OF THE PRESENT INVENTION

Figure 1:
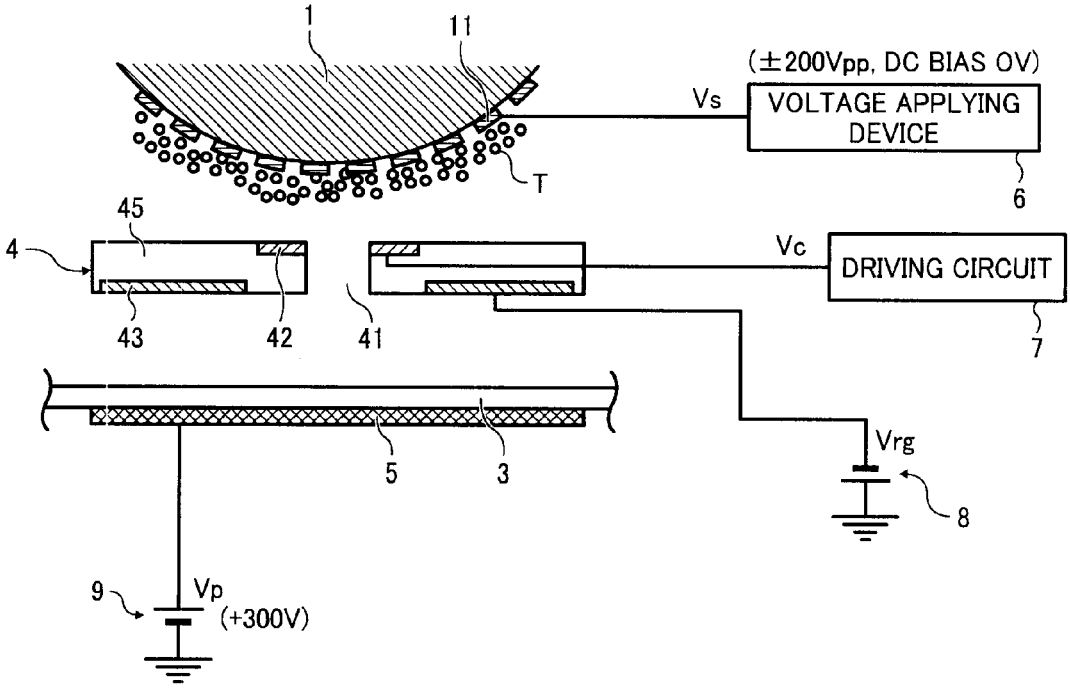
FIG. 1 typically illustrates an exemplary configuration according to one embodiment of the present invention.

Referring now to the drawings, wherein like reference numerals and marks designate identical or corresponding parts throughout several figures, in particular in FIG. 1, an image forming apparatus is described. As shown, a first embodiment of the image forming apparatus includes a roller state toner bearing member 1 that bears and causes toner T to soar, a printing medium 3 to which the toner T is adhered, and a toner control device 4, having plural toner passage holes 41, arranged between the toner bearing member 1 and the printing medium 3.

The toner bearing member 1 includes plural electrodes 11 on its surface extending in an axial direction perpendicular to a direction in which toner T is conveyed with a prescribed pitch. A pulse voltage application device (e.g. power supply) 6 applies a timely changing pulse voltage (i.e. a cloud pulse) to each of the electrodes 11 on the toner bearing member 1.

For example, a pulse voltage Vs is applied at a frequency from 0.5 to 7 kHz. Since an interval of the respective electrodes 11 is finely formed, an intensive electric field is created therebetween. Thus, the toner T vigorously soars from an electric field having a prescribed voltage that repels the toner T of a charge polarity and is pulled by an electrode 11 having a prescribed voltage attracting the toner T. The toner repeats such up and down soaring in accordance with a pulse frequency in response to switching of the pulse voltage Vs and becomes a cloud state.

The toner control device 4 includes plural lines of toner passage holes (e.g. openings) 41, which the toner T can pass through, as typically shown in FIG. 1. In the periphery of the toner passage hole 41 on the toner supply side surface of the toner control device 4, a ring state control electrode 42 is arranged. A common electrode 43 is further arranged on the printing surface side beside the toner passage hole 41.

Figure 2:
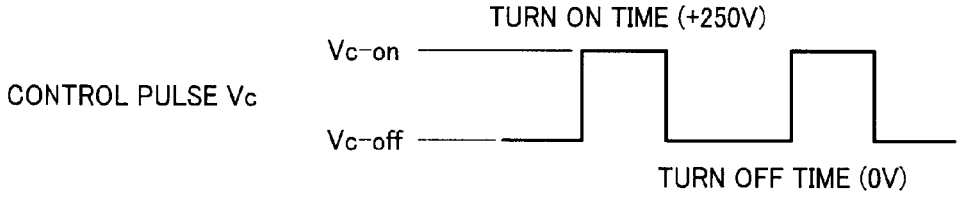
FIG. 2 illustrates an exemplary control pulse applied to a control electrode.

To the control electrode 42, a control pulse Vc is applied from a drive circuit 7 constituting a control pulse application device as shown in FIG. 2. In this situation, when the toner passage hole 41 is brought into a condition allowing the toner T to pass (i.e., ON condition), a voltage Vc-on is applied to the control electrode 42. Whereas when the toner passage hole 41 is brought into a condition prohibiting the toner T to pass (i.e., OFF condition), a voltage Vc-off is applied to the control electrode 42. Further, a voltage Vrg is always applied from a power supply 8 to the common electrode 43 to prevent mutual interference due to crosstalk of neighboring electric fields on a print surface side region.

The control electrode 42 can sufficiently operate even only arranged in the periphery of the passage hole 41. However, the control electrode 42 can be arranged either only on an inner wall surface of the passage hole 41 or both on the same and in the periphery of the toner bearing member side.

To the backside surface of the printing medium side, a bias voltage Vp is applied to attract toner T having passed through the toner control device 4 to the printing medium 3. Specifically, a backside electrode 5 is arranged as an opposing electrode device serving as a bias voltage application device. To attract the toner T having passed through the toner control device 4 to the printing medium 3, a bias voltage Vp is applied from the bias power supply device 9.

The printing medium 3 can be an intermediate transfer-printing medium capable of temporarily forming an image thereon and transferring the same onto a sheet or a printing sheet. To apply the bias voltage Vp to the printing medium 3, a backside electrode 5 can be arranged on a backside of the printing medium 3 (e.g. an opposite side surface of the toner bearing member 1), while the printing medium 3 is conveyed on the backside electrode 5. When the intermediate transfer-printing medium is used, an electrode can be embedded therein (e.g. an opposing electrode device on the printing medium side serves as an inner electrode) or the backside electrode 5 can be arranged on the backside thereof.

As a cloud making device that makes cloud toner on the surface of the toner-bearing member 1, plural electrodes 11 are alternately arranged on the surface of the toner-bearing member 1 in the rotational direction to receive a voltage Vs. Specifically, these electrodes 11 form a two-phase and are arranged with a pitch p, to which a voltage capable of attracting and repelling toner T between the neighboring electrodes 11 is applied. Otherwise, two-phase voltages are applied to neighboring electrodes 11.

Figure 3A:
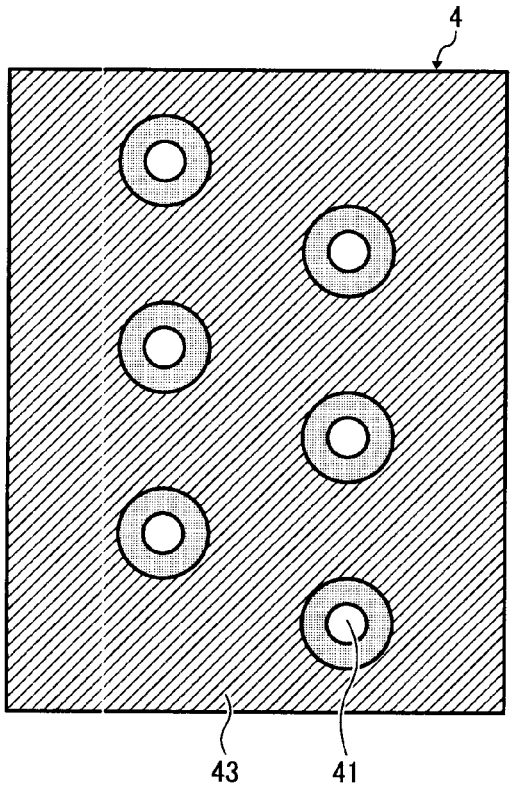
FIG. 3A illustrates a printing surface side of an exemplary toner control device.
Figure 3B:
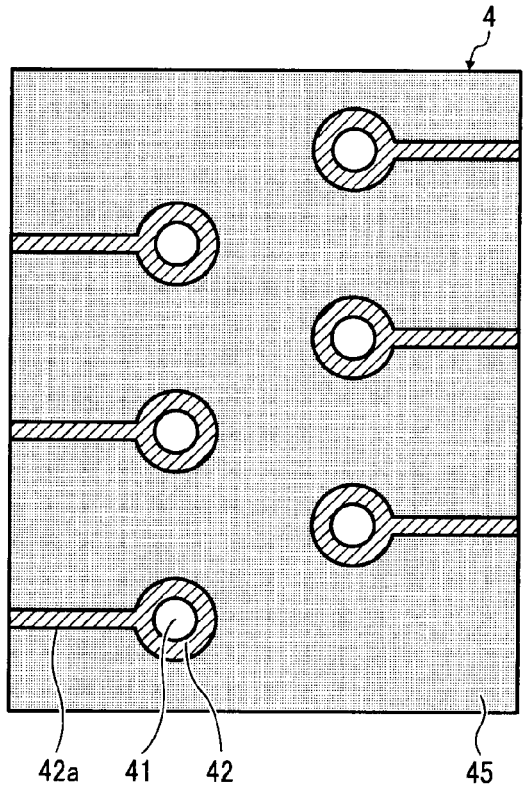
FIG. 3B illustrates a toner supply surface side of the exemplary toner control device.

Now, an exemplary toner control device 4 is described with reference to FIGS. 3A and 3B. As shown, on the toner supply side of the insulation substrate 45, a ring state control electrode 42 having a width of from 10 to 100 micrometer is arranged surrounding the toner passage hole 41.

A diameter of the toner passage hole 41 is determined based on a diameter of a dot to be formed, and is preferably from 50 to 200 micrometer. A lead pattern 42*a* connects the driver circuit 7 with the control electrode 42, which controls passage of the toner T.

The print surface side includes a common electrode 43 on a section other than a periphery of the hole. The common electrode 43, and receives a DC voltage not to be affected by neighboring electric fields even if voltages Vc-on and Vc-off are applied to the control electrode 42. Specifically, in order to independently form an electric force line flux having a prescribed electric force between the toner supply side and the printing medium side per toner passage hole, it is attempted to suppress the mutual interference when toner soars from plural nozzle passage holes in a multi driving condition.

Such a toner control device 4 is produced in the following manner. Specifically, in views of cost and a manufacturing process, resin film, such as polyimide, PET, PEN, PES, etc., having a thickness of from 30 to 100 micrometer is employed as an insulation member of the substrate 45. Initially, aluminum vapor deposition coats are formed on both sides of a film. As a photolithography process applied to the surface, a photo registration is coated having a thickness of from 0.2 to 1 micrometer using a spinner. Previous baking, mask exposure, and development are then executed. Then, photo registration is heated and hardened. Similarly, as a pattern of the printing medium surface side, the photolithography process is executed on the backside in the same manner as above. Then, aluminum patterning is executed using aluminum etching liquid.

To precisely form the toner passage hole 41 while avoiding positional deviation, a machine process by means of pressing is applied after pattern formation, an excimer laser process is applied to a pattern, or a dry etching process such as sputter etching process using a metal mask, etc., is applied.

In the image forming apparatus configured in this way, when two-phase pulse voltages having a different phase of 180 degree are applied to the electrodes 11, toner T soars and is clouded on the toner bearing member 1 and is conveyed as the toner bearing member 1 rotates. To the backside electrode 5, a print bias voltage Vp is applied.

In this situation, a voltage Vrg is applied to the common electrode 43 and a voltage Vc-on of an ON condition voltage as shown in FIG. 2 is applied to the control electrode 42 when the toner T is controlled to pass through the toner passage hole 41 (ON condition). Whereas a voltage Vc-off of an OFF condition voltage as shown in FIG. 2 is applied when the toner T is prohibited to pass through the toner passage hole 41 (OFF condition).

In such a situation, prescribed voltages to be applied to the respective electrodes 11, 5, 42, and 43 as mentioned later are designated, an electric line flux 10 is formed from the side of the printing medium 3 to the toner supply side when the voltage Vc-on is applied.

Thus, the toner in the cloud state on the toner bearing member 1 reaches the printing medium 3 passing through the toner passage hole 41 riding on the electric field of the electric line flux 10. Accordingly, by controlling opening (turning on and off) of the toner control device 4 in accordance with presence of an image, a toner image can be directly formed on the printing medium 3.

Now, a pulse voltage Vs to be applied to an electrode 11, a bias voltage Vp applied to a printing medium side, and a control pulse voltage Vc to be applied to a control electrode 42 are described more in detail with reference to FIG. 4.

As shown, a pulse voltage (e.g. a timely changing voltage) Vs is applied to the electrode 11. A wave height of the bias voltage is designated in accordance with the pitch or usage toner. According to an experiment, it was revealed that toner can soar when the voltages are designated within from ±60 to ±300 Vpp (pp: peak to peak). In this simulation, ±200 Vpp with a DC zero volt component is applied. A gap d between the toner bearing member 1 and the toner control device 4 is 0.2 mm.

Further, the diameter of the toner passage hole 41 is 120 micrometer, a width of the ring state control electrode 42 in a hole center direction is 50 micrometer, and an interval between the common electrode 43 and the hole is 50 micrometer.

A voltage applied to the common electrode 43 is zero.

A control pulse voltage Vc-on of +250V is applied to the control electrode 42 when the toner T is allowed to pass through the toner passage hole 41 (i.e., a turn ON condition). Whereas a control pulse voltage Vc-on of 0V is applied to the control electrode 42 when the toner T is prohibited to pass through the toner passage hole 41. Although a bias voltage Vp applied to the backside electrode 5 depends on the interval between the toner control device 4 and the printing medium 3, but preferably ranges from +200 to +1500V of the DC voltage. In the embodiment of FIG. 4, the interval between the toner control device 4 and the printing medium 3 is 0.3 mm, while a voltage DC+800V is applied to create potential inclination, so that negatively charged toner is attracted to the surface of the printing medium 3.

Figure 4A:
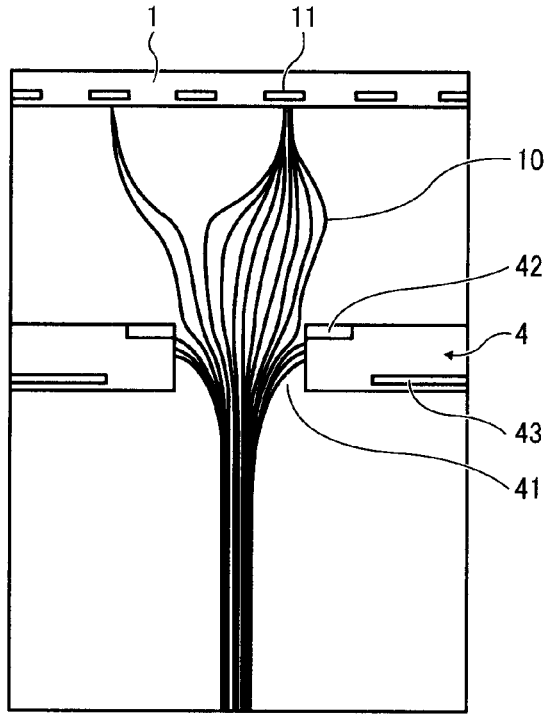
FIG. 4A illustrates an exemplary electric force line passing through a toner passage hole obtained based on a simulation result of a two dimensional cross sectional electric field intensity distribution when the toner control device is in a toner passage possible condition.

When prescribed voltages are applied to the respective electrodes 11, 42, 43, and 5 as designated in the above-mentioned relation, and accordingly, negatively charged toner is allowed to pass through the toner passage hole 41 as shown in FIG. 4A, lots of the electric flux lines flowing from the electrode 5 on the printing medium 3 side that receives the largest positive voltage pass through the toner passage hole 41 and reach the toner bearing member electrode 11 that receives the smallest voltage of −200V.

Specifically, the electric flux lines 10 flowing from the electrode 5 and passing through the toner passage hole 41 reaches the lowest electrodes 11 of −200V at two positions.

Accordingly, either negatively charged toner in the cloud state on the toner bearing member 1 or toner existing in the vicinity of the bearer electrode receiving the voltage of −200V passes through the toner passage hole 41 along the electric flux lines 10, so that the toner T can soar on the surface of the printing medium 3.

Figure 4B:
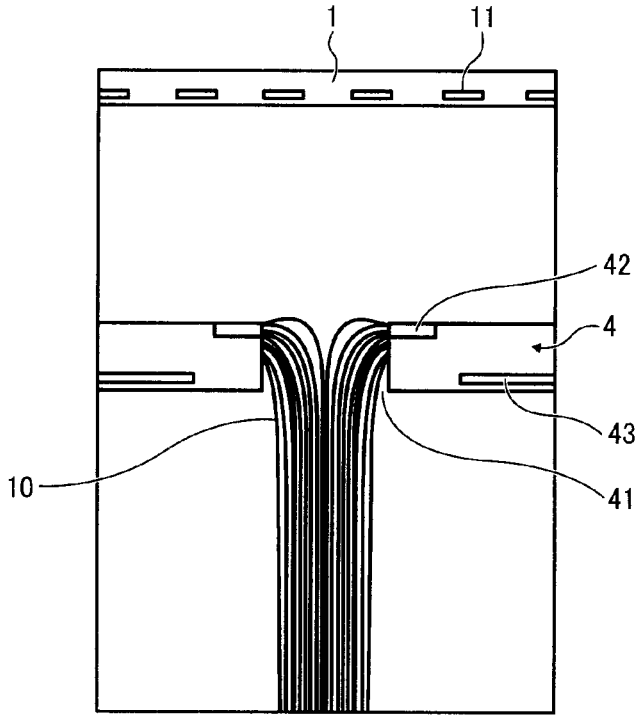
FIG. 4B illustrates an exemplary electric force line passing through a toner passage hole obtained based on a simulation result of a two dimensional cross sectional electric field intensity distribution when the toner control device is in a toner passage impossible condition.

Whereas when the toner T is to be prohibited to pass through the toner passage hole 141 (i.e., an OFF condition) as shown in FIG. 4B, −200V is applied to the control electrode 42. Although, the lower voltage side of the electrode 11 is similarly −200V, and electric flux lines flowing from the electrode 5 entirely enter the control electrode 42 approximately arranged thereto. Accordingly, the toner on and above the surface of the toner bearing member 1 does not soar toward the electrode 5. The voltage applied to the control electrode 42 in this prohibiting condition (i.e. the OFF condition) is not necessarily the same as that of the lower voltage side of the electrode 11. Specifically, the toner T can be blocked (the OFF condition) as far as a condition that the electric flux lines passing through the toner passage hole 41 do not reach the surface of the toner bearing member 1 is met.

Now, one example of the image forming apparatus is described with reference to FIG. 5. As shown, the image forming apparatus forms a color image by providing four items of units as mentioned above while making clouds of four component color toner of yellow, magenta, cyan, and black, and executing ON/OFF control using a toner control device.

Specifically, the image forming apparatus includes four toner supply units 100Y, 101M, 101C, and 101K (hereinafter collectively referred to as a toner supply unit 100 when color is not important) which make and supply four clouds of component color toners of yellow, magenta, cyan, and black. Between the respective toner supply units 100 and an intermediate transfer printing medium 103, there is arranged a toner control device 104 having similar configuration to the toner control device 4 of the above-mentioned embodiment.

The intermediate transfer-printing medium 103 is wound around two rollers 132 and 133 and circulates n a direction as shown by an arrow. A backside electrode 105 serving as a printing medium side electrode is arranged corresponding to the respective toner supply units 100 on the backside (e.g. an inner side) of the intermediate transfer printing medium 103. Further, a cleaning unit 135 is provided to remove toner remaining on the intermediate transfer printing medium 103 after a transfer process.

The toner supply unit 100 includes a cylindrical toner bearing member 101 having the similar configuration as the toner bearing member 1 which includes plural electrodes 111 arranged side by side to receive voltages for making toner in a cloud state. The toner supply unit 100 also includes a toner-replenishing roller 113 that rotates and replenishes the toner to the toner bearing member 101, and a blade 114 that determines an amount of toner on the toner-bearing member 101.

In this example, the toner is repelled from the toner replenishing roller 113 to the toner bearing member 101, because the toner is charged by friction caused between the toner replenishing roller 113 and that the toner bearing member 101. Further, the blade 114 arranged downstream of the toner replenishing roller 113 makes a thin lay of a prescribed amount of the toner on the surface of the toner bearing member 101 while stabilizing a charge amount thereof.

Then, when the toner control device 104 executes turn ON/OFF control in accordance with presence of an image, the toner supplied by the toner supply unit 100 soars on the intermediate transfer printing medium 103, so that a color toner image is formed on the intermediate transfer printing medium 103.

A sheet feeding section 151 is arranged at a lower part to accommodate printing sheets 150. The printing sheet 150 is fed by a pickup roller 152 from the sheet feeding section 151 and receives a toner image formed on the intermediate transfer printing medium 103 at a position of a transfer roller 153 opposing the roller 132 winding the intermediate transfer printing medium 103. A fixing unit 160 fuses the toner onto the printing sheet 150. The printing sheet is then ejected.

Even not shown, due to application of a positive bias to the transfer roller 153 arranged on the backside of the printing sheet 150, a toner image is transfer onto the surface of the printing sheet 150 from the intermediate transfer printing medium 103. As mentioned above, the cleaning unit 135 removes the toner remaining on the intermediate transfer printing medium 103 therefrom, and the next image formation is prepared.

As mentioned, the image forming apparatus employs the intermediate transfer printing system that forms four color images on the intermediate transfer printing medium and transfers the same onto the printing sheet fed from the sheet feeding section. In such an intermediate transfer printing medium system, it is easy to maintain a constant interval between the printing surface (i.e. an image formation surface at which toner arrives) and the toner control device, so that a high quality image can be obtained even when a toner slowly soars. Further, the printing surface can be smooth avoiding accumulation of electric charge and a change of voltage, if a cubic resistance is adjusted. An image forming apparatus that directly executes printing by controlling clouded toner to turn on/off is generally highly sensitive to a voltage. Thus, the image forming apparatus tends to change image quality in response to a change of a printing surface bias voltage. However, according to the above-mentioned configuration, a high quality color image can be obtained.

Figure 6:
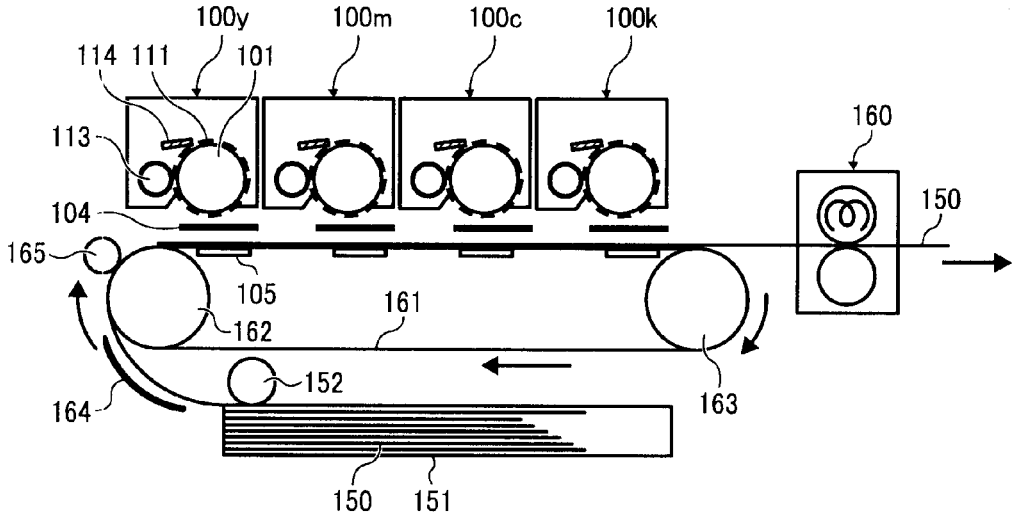
FIG. 6 typically illustrates another exemplary image forming apparatus according to one embodiment of the present invention.

Now, another image forming apparatus is described with reference to FIG. 6. As shown, the image forming apparatus directly forms an image on a printing sheet as a printing medium. Specifically, a printing sheet 150 is fed from the sheet feeding section 151 and is electrostatically attracted to a sheet conveyance belt 161. The printing sleet 150 is conveyed through the toner supply unit 100. Then, a color image is directly formed on the printing sheet 150 by the ON/OFF control of the toner control device 104 in accordance with presence of an image.

The sheet conveyance belt 161 is made of polyimide or the like and is circulated being wound around two rollers 162 and 163 in a direction as shown by an arrow. The sheet conveyance belt 161 is charged by a charge device, such as a charge roller, etc., not shown, and electrostatically absorbs and conveys the printing sheet 150. A guide 164 and a registration roller 165 for guiding the printing sheet 150 from the sheet feeding section 105 to the sheet conveyance belt 161 are arranged.

Since the sheet conveyance belt 161 and the printing sheet 150 are sandwiched between the toner control device 104 and the backside electrode 105, it is difficult to significantly narrow an interval between the toner control device 104 and the backside electrode 105. However, an image quality rarely deteriorates with toner scattering during toner transfer. Because, a transfer process is omitted and the color image is directly formed on the printing sheet 150.

Figure 5:
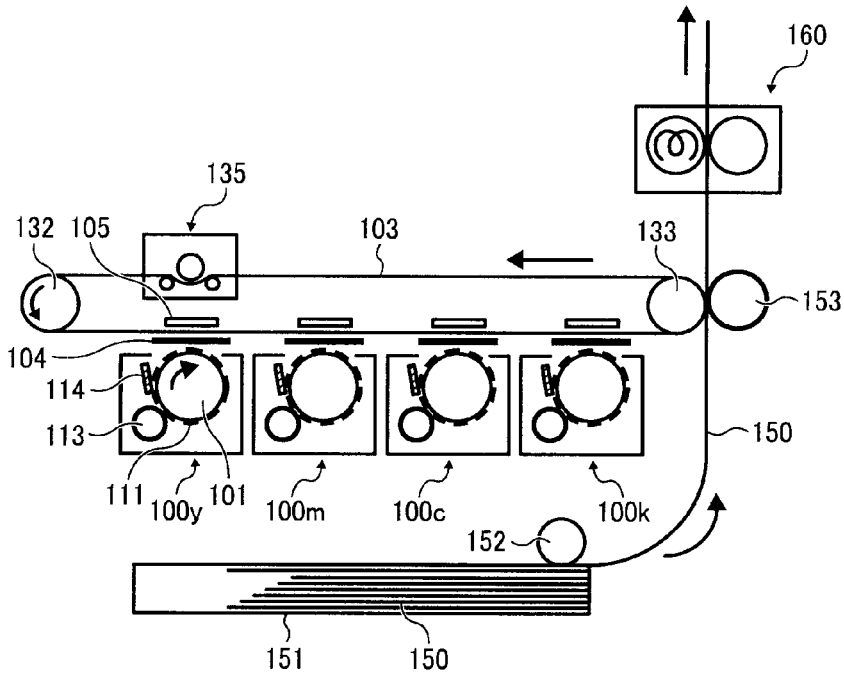
FIG. 5 typically illustrates an exemplary image forming apparatus according to one embodiment of the present invention.

Further, since the belt cleaning mechanism of FIG. 5 or the like is not needed, a small and low cost image forming apparatus can be obtained. Since a toner cloud is made, and the toner can be guided under a low printing surface bias (i.e., backside electrode bias), an arriving speed of the toner at a sheet surface can be decreased. As a result, an image forming apparatus produces a high quality image while avoiding scattering of the toner.

Figure 7A:
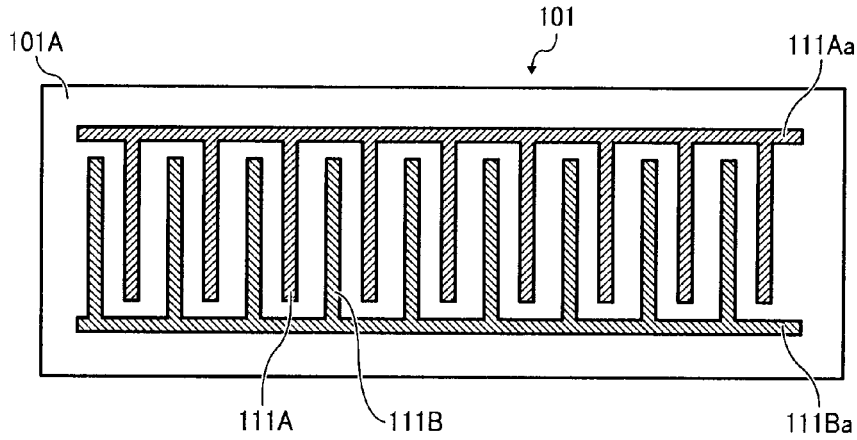
FIG. 7A is an exploded view typically illustrating the exemplary toner bearing member.
Figure 7B:
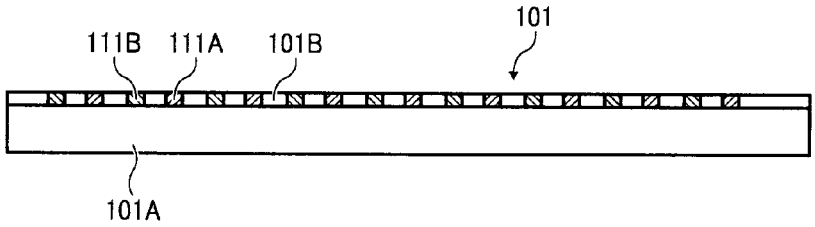
FIG. 7B is a cross sectional view typically illustrating the exemplary toner bearing member.
Figure 8:
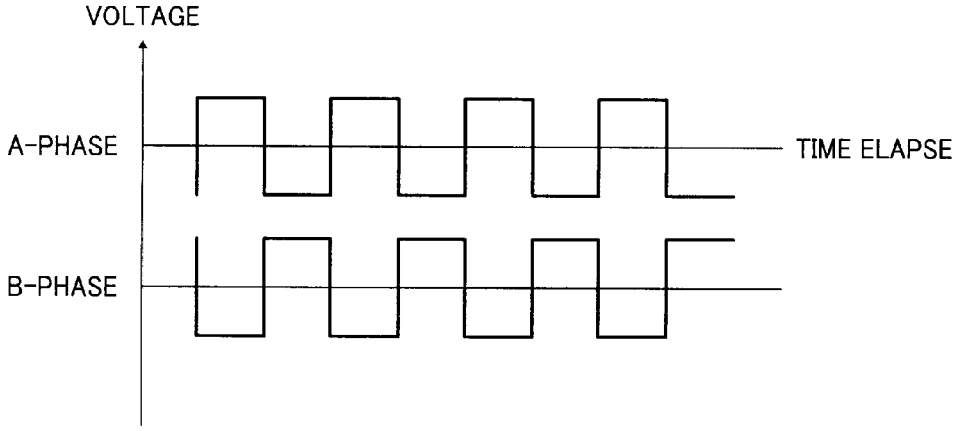
FIG. 8 illustrates exemplary pulse voltages applied to electrodes included in the toner bearing member.

Now, an exemplary toner bearing member employed in the above-mentioned image forming apparatus is described with reference to FIGS. 7A and 7B. As shown, plural comb sate electrodes are arranged on the surface of the toner-bearing member 101. Specifically, two phase use electrodes are provided, in which every other electrodes portions are connected at one ends, while two phase pulses having a different phase from the other by 180 degree as shown in FIG. 8 are applied. Thus, a two-phase electric field is created on the toner bearing member such that attraction and repulsive motions repeat between neighboring electrode portions.

Specifically, plural comb state electrodes 111 of A and B phase uses (111A and 111B) are arranged on a surface of an insulation substrate 101A. A surface protection layer 101B is further arranged on the plural electrodes 111. The comb state electrode portions 111A and 111B are arranged in parallel to each other with a fine pitch in a toner conveyance direction. The both sides of the portions are connected to a two-phase pulse generation circuit, not shown, arranged outside via common bus lines 111Aa and 111Ba.

Frequencies of pulse voltages applied to the electrodes 111A and 111B are 0.5 to 7 kHz. The pulse voltages each include a DC voltage as a bias. Respective wave heights of the pulse voltages are preferably from ±60 to ±300V in accordance with a width and an interval of the electrode portions. When the two-phase electric field is used, toner repeatedly soars being repelled and attracted, thereby reciprocates between the neighboring electrode portions in response to switching of a direction of a neighboring electric field. At the same time, the toner-bearing member 101 rotates in a toner conveyance direction.

In this way, a cloud making device that causes toner to soar on the surface of the toner-bearing member 101 member and includes plural electrode portions arranged at a prescribed interval while extending in a direction perpendicular to the toner conveyance direction on the surface of the toner-bearing. Thus, when voltages are applied to the respective electrodes, the neighboring electrodes alternately attract and repel toner therebetween repeatedly, so that the toner is clouded and conveyed as the toner-bearing member rotates. Thus, the toner can be stably conveyed over the surface of the toner-bearing member 101 avoiding changing quality, and as a result, an image forming apparatus can be reliable.

Figure 9A:
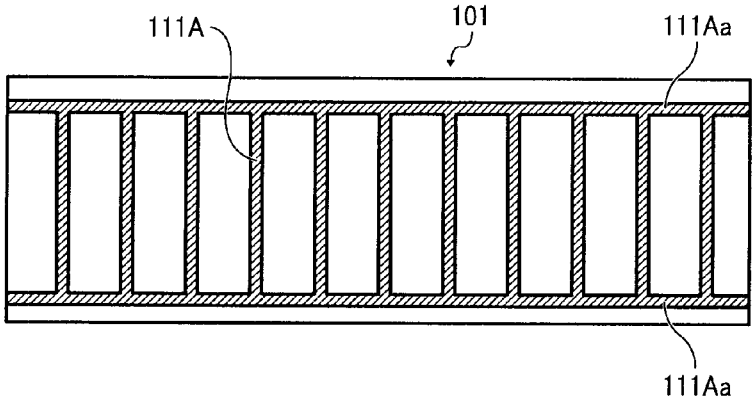
FIG. 9A is an exploded plan view typically illustrating another exemplary toner bearing member.
Figure 9B:
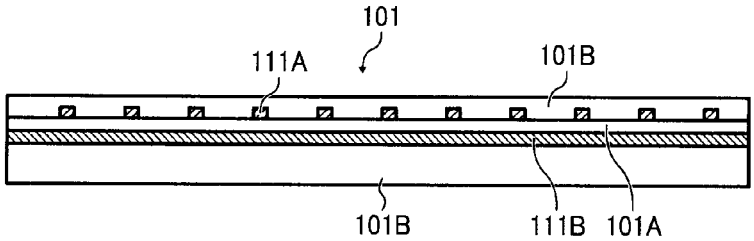
FIG. 9B is a cross sectional view typically illustrating the other exemplary toner bearing member.

Now, another exemplary toner bearing member employed in the image forming apparatus is described with reference to FIGS. 9A and 9B. As shown, plural electrodes are provided on the surface of the toner-bearing member 101. All of electrode portions on a surface layer are connected with each other. A conductive substrate electrode 111B arranged on a lower layer via an insulation layer. Two-phase pulses having a different phase from the other by 180 degree are applied between these electrodes 111A and 111B as shown in FIG. 8. Thus, a toner bearing member repeats attraction and repelling of toner on a reciprocal basis in an electric fields created by the surface layer side electrode and the lower layer conductive substrate electrode.

Specifically, as the plural electrodes, the toner bearing member 101 of this embodiment includes the A-phase use electrode 111A arranged on the surface of an insulation substrate 101A, the (solid) flat conductive B-phase use electrode 111B arranged on the lower surface of the insulation substrate 101B, and a protection layer 101B arranged on the surface of the electrodes 111A as in FIG. 7. The surface side electrode 111A includes portions arranged with a fine pitch in a toner conveyance direction side by side. The both sides of these portions are connected to a two-phase pulse generation circuit, not shown, arranged outside via a common bus line 111Aa.

A frequency of each of the two-phase pulse voltages is preferably from 0.5 to 7 kHz. The pulse voltage includes a DC voltage bias and a wave height of preferably from ±60 to ±300V. Thus, the pulse voltage is applied in accordance with a width and an interval of the electrode portions as described with reference to FIG. 7. Thus, toner repeatedly soars between the surface layer side electrode portions 111A in response to switching of the two-phase pulse when the two-phase electric field is used. At same time, the toner-bearing member 101 rotates in a toner conveyance direction.

The above-mentioned insulation substrate 101A is made of insulation material, such as rein, ceramics, etc. Otherwise, an insulation coat, such as $SiO_2$, etc., can be coated onto a conductive substrate made of aluminum or the like. Yet otherwise, flexible material, such as polyimide, etc., can be used. Further, to produce the electrode 111, conductive material, such as Al, Ni—Cr, etc., having a thickness of from 0.1 to 1 micrometer is coated onto the base substrate and then shaped into an electrode pattern using a photolithography technology or the like. Otherwise, a copper foil is laminated or patterned using a photolithography after being plated. The lower layer conductive substrate electrode 111B of FIG. 9 is preferably made of conductive material, such as Al, Ni—Cr, etc.

The surface protection layer 101B having a thickness of from 0.5 to 2 micrometer made of such as $SiO_2$, $TiO_2$, TiN, $Ta_2O_5$, etc., can be vaporized and coated. Otherwise, organic material, such as polycarbonate, polyimide, methyl methacrylate, etc., having a thickness of form 2 to 10 micrometer is printed and coated and is then heated and hardened.

In thus configured toner bearing member 101, when a soaring use pulse is applied from a drive circuit and a soaring electric field is created, toner charged on the toner bearing member 101 receives repelling and attraction forces, and the toner soars up and down, and is conveyed in a traveling wave direction.

Figure 10:
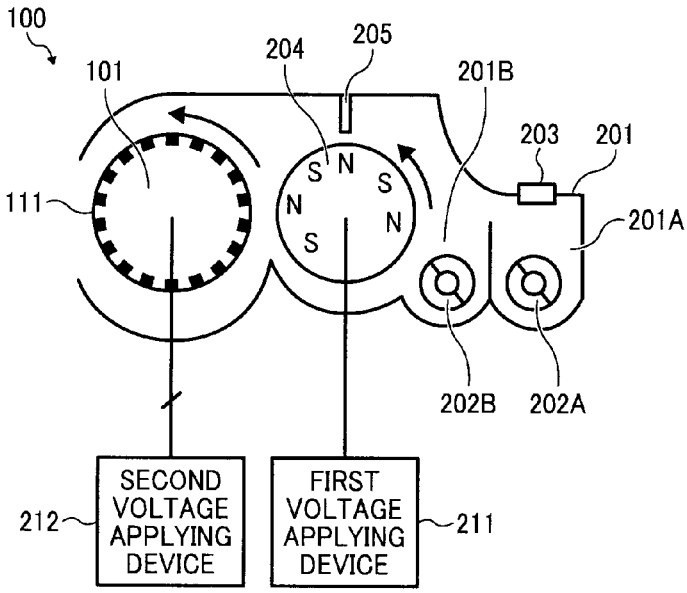
FIG. 10 illustrates an exemplary toner supply unit according to another embodiment of the present invention.

Now, an exemplary toner supply unit 100 employed in the above-mentioned image forming apparatus is described with reference to FIG. 10. As shown, the toner supply unit 100 uses two-component printing agent including magnetic carrier and non-magnetic toner. A printing agent containing section 201 is separated into two chambers 201A and 201B communicated with each other by a printing agent passage, not shown, arranged at both ends in the toner supply unit 100. The two component printing agent accommodated in the printing agent containing section 201 is conveyed therein being stirred by stir conveyance screws 202*a* and 202B arranged in the respective chambers 201*a* and 201B.

A toner replenishment inlet 203 is arranged in the chamber 201A. Toner is replenished from a toner containing section, not shown, via the toner replenishment inlet 203 into the printing agent-containing section 201. The printing agent-containing section 201 includes a toner density soar, not shown, that detects permeability of the printing agent. Thus, when toner density decreases in the printing agent containing section 201, fresh toner is replenished thereto via the toner replenishment inlet 203.

At a position opposing the stir conveyance screw 202B, there is arranged a magnetic brush roller 204 as a toner replenishing roller. Magnet is secured inside the magnetic brush roller 204. Thus, the printing agent in the printing agent-containing section 201 is lifted up onto the surface of the magnetic brush roller 204 by a magnetic and rotation force of the magnetic brush roller 204. A printing agent layer thickness-determining member 205 is arranged opposing the magnetic brush roller 204 at a position downstream than a section where the toner is lifted up.

The printing agent lifted up at the lifting up position is smoothed by the printing agent layer thickness determination member 205 to have a prescribed thickness. The printing agent passing through the printing agent layer thickness determination member 205 is conveyed to a position opposing the toner bearing member 101 as the magnetic brush roller 204 rotates. The magnetic brush roller 204 receives a supply bias from a first voltage application device 211.

The electrode 111 of the toner-bearing member 101 receives a voltage from a second voltage application device 212 as shown in FIGS. 7 and 9. Accordingly, an electric field is created between the toner bearing member 101 and the magnetic brush roller 204 by the first and second voltage applying device 211 and 212. Thus, the toner receives an electrostatic force from the electric field and separates from the carrier, thereby moving to the surface of the toner-bearing member 101. The toner arrived at the surface of the toner bearing member 101 is made into a cloud state by the electric field, which is created by the voltage applied to the electrode 111 from the second voltage applying device 212. Thus, the toner is conveyed by either rotation or a traveling wave electric field of the toner-bearing member 101.

The toner conveyed to the position opposing the toner control device 104 selectively soars toward the printing medium by a toner passage ON/OFF control electric field, which is created by the control electrode 42, so that a dot printing of the toner is controlled.

Figure 11:
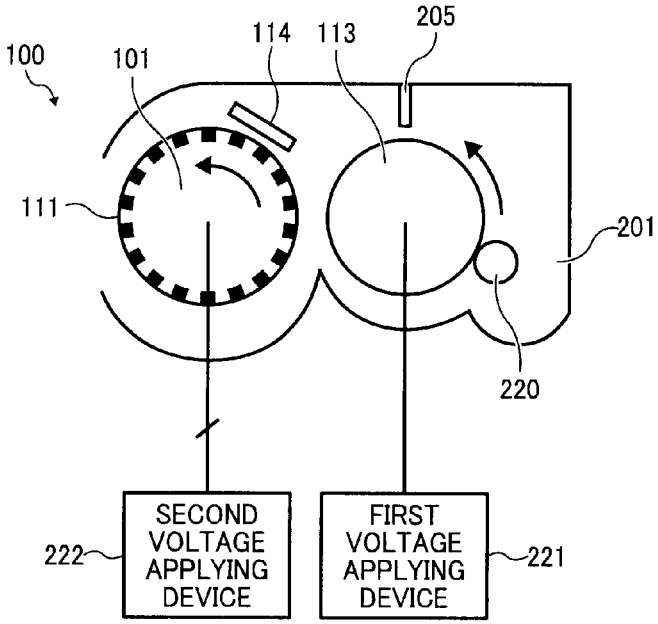
FIG. 11 illustrates another exemplary toner supply unit according to yet another embodiment of the present invention.

Now, an exemplary toner supply unit 100 employed in the above-mentioned image forming apparatus is described with reference to FIG. 11. As shown, the toner supply unit 100 uses one component-printing agent including non-magnetic toner. The toner is accommodated in a print agent-containing section 201. The toner is charged by friction created between a charge roller 220 and a toner-replenishing roller 113, and is lifted up onto the toner-replenishing roller 113 due to the electrostatic force. The toner on the toner replenishing roller 113 is made into a thin layer by a printing agent layer thickness determination member 205, and is conveyed to a position opposing the toner bearing member 101 as the toner replenishing roller 113 rotates.

At this moment, a supply bias is applied to the toner-replenishing roller 113 by the first voltage-applying device 221. The second voltage-applying device 222 applies a voltage to the electrode 111 of the toner-bearing member 101. Accordingly, an electric field is created between the toner-bearing member 101 and the toner-replenishing roller 113 by the first and second voltage applying devices 221 and 222. Thus, the toner receives an electro static force from the electric field and separates from the toner-replenishing roller 113 and moves to the surface of the toner-bearing member 101.

Similar to the above-mentioned example, the toner arriving at the surface of the toner-bearing member 101 is made in to a cloud state by the electric field, which is created by the voltage applied to the electrode 111 from the second voltage-applying device 222. Then, the toner is conveyed by rotation and the traveling wave electric field of the toner-bearing member 101.

Then, the toner conveyed up to a position opposing the toner control device 104 selectively soars due to the toner passage ON/OFF control electric field of the control electrode 42, so that dot printing of the toner is controlled.

In the respect toner supply units 100, the toner not contributed to printing is further conveyed by the toner-bearing member 101 and is collected by a collecting device, not shown, from the surface of the toner-bearing member 101. The collected toner is again returned to a printing agent collection section 201 and circulates within the toner supply unit 100.

Although the negatively charged toner is used in the above, a positively charged toner can be used.

Figure 12:
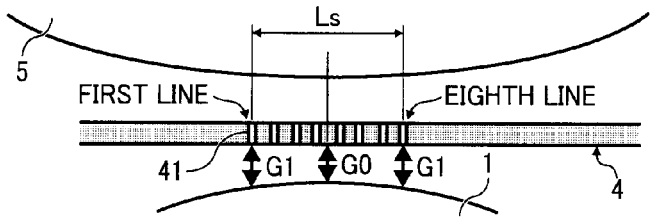
FIG. 12 illustrates an exemplary variation in a space distance between a control electrode included in a toner control member and the toner bearing member.

Now, exemplary influence of a change of a gap between the toner bearing member having a prescribed surface curvature and the almost flat control electrode of the control device is described with reference to FIG. 12.

As shown, the toner-bearing member 1 and the control device 4 are arranged opposing each other. Eight lines each having prescribed toner passage holes 41 in a widthwise direction are arranged in a moving direction of the printing medium 3 on the toner control device 4. When a pixel is printed by eight dots of 600 dpi, an interval between nozzle lines is 0.339 mm and a distance Ls from first to eight nozzle lines is 2.37 mm, for example.

When a space distance at a center between the fourth and fifth lines is represented as G0, where the toner control device 4 most approximates the toner bearing member 1, that at a first or eight line is represented as G1, a diameter of the toner bearing member 1 is 15 mm, and such G0 is 200 micrometer, G1 almost amounts to 290 micrometer with 45% increase of the smallest space distance.

Thus, the electric flux lines are loosely narrowed and a traveling distance of the toner increases at the first and eighth lines of the toner passage hole 41, and accordingly, an amount of the passage toner arriving at the printing medium decreases down to less than that on the fourth and fifth lines. Thus, density accordingly decreases in comparison with that through the fourth and fifth lines.

Figure 13:
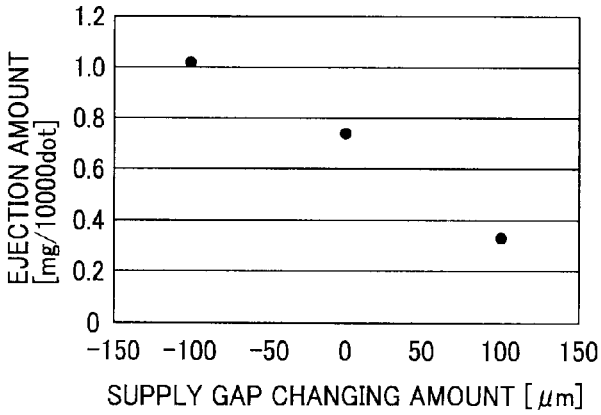
FIG. 13 illustrates an exemplary relation between the variation of the space distance and a toner-ejecting amount (i.e. passage amount)

An exemplary relation between a change of the gap G and a traveling amount of toner obtained through an experiment is now described with reference to FIG. 13. The relation represents toner traveling amounts measured by changing an amount of the gap by −100 micrometer (to be 100 micrometer), 0 (to be 200 micrometer), and +100 (to be 300 micrometer). As shown, the value 76 mg/1,000 dot obtained when the change amount is 0 (i.e., the gap is 200 micrometer at G0) decreases down to 34 mg/1,000 dot when the change amount is +100 (i.e., the gap is 300 micrometer). Thus, when the change amount is about 90 micrometer at G1, it is supposed based on the above-mentioned liner relation that the value decreases down to about 0.38 mg/1000 dot as being 50% decrease in comparison with a case when the change amount is zero.

Now, an exemplary control section according to one embodiment of the present invention is described with reference to FIGS. 14 and 15.

As shown, this exemplary control section includes the toner control device 4 that includes eight lines of toner passage holes 41 in the moving direction of the printing medium. In each of the lines, the plural toner passage holes 41 are formed at a prescribed interval in the widthwise direction as mentioned corresponding to a prescribed printing density.

The control section includes a CPU 501 that generally controls the image forming apparatus, a ROM 502, and a RAM 503. Also included are an image processing ASIC 504, a periphery control circuit 505, an USB I/F 506 as an external Image forming apparatus PSU 507, and a prescribed number (e.g. eight) of counters 511 corresponding to a number of lines of the toner passage holes 41. Further included is a driver IC 530 as shown in FIG. 15 and the like. The counters 511 are typically illustrated for the first to the fourth lines among the eight lines.

Figures 16, 17, 18:
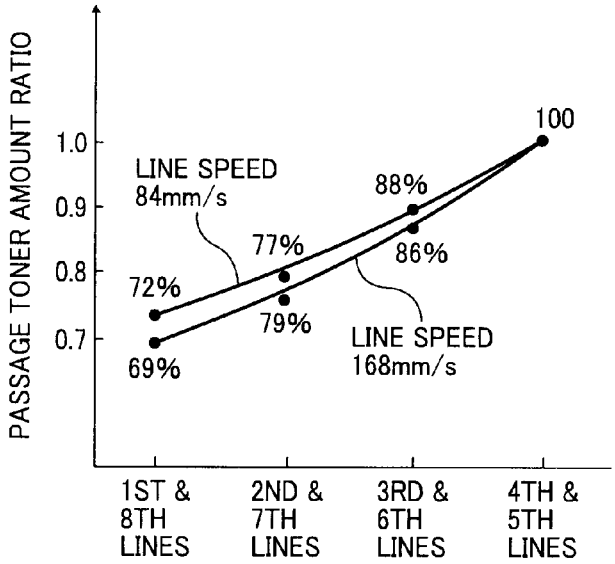
FIG. 16 illustrates an exemplary pulse width data table according to yet another embodiment of the present invention.
FIG. 17 illustrates another exemplary pulse width data table according to one embodiment of the present invention.
FIG. 18 illustrates an exemplary relation between a printing line speed, an amount of passage toner, and a line position of toner passage holes.

As shown in FIG. 16, the ROM 502 stores a pulse width data table that includes pulse width data of a control pulse Vc to be applied to the control electrodes 42 for the toner passage holes on the first to eighth lines. The pulse width of the control pulse Vc controls the toner passage hole 41 to allow the toner to pass through.

The driver IC 530, corresponding to the drive circuit 7, includes a shift register that inputs serial data transmitted from the image processing ASIC 504 in accordance with a shift clock, a latch circuit 532 that latches data stored in the shift register 531 based on a latch signal transmitted from the image processing ASIC 504, and an AND circuit 533 that applies logical multiplication to data transmitted from the latch circuit 532 and control pulses P1 to P8 transmitted from the counters 1 to 8. Also included are a DC high voltage power supply 534 turned on and off by an output of the AND circuit and a high voltage switch circuit 535 receiving an input of a high voltage (e.g. DC 200V) from the DC high voltage power supplies 534. An output from the high voltage switch circuit 535 is applied to the control electrode 42 of the toner control device 4 as the control pulse Vc.

When the control section receives printing data from a prescribed external apparatus via the USB I/F 506, the CPU 501 stores the printing data one after another in the RAM 503. When the data is entirely received, the CPU 501 instructs the image processing ASIC 504 to reorder printable data. Thus, the image processing ASIC 504 takes in the printing data from the RAM 503 without intervention of program of the CPU 501, and entirely stores the same in a buffer included in the ASIC while automatically reordering thereof.

When the reordering is completed by the image processing ASIC 504, the peripheral control circuit 505. Causes a sheet feed motor 521, a toner bearing member use drive motor 522, a printing medium conveyance use motor, a fixing motor, and a various high voltage power supplies 524 to be operable.

When the printing medium reaches a prescribed position, a sensor inputs a detection signal to the peripheral control circuit 505 and the image processing ASIC 504 is started. The image processing ASIC 504 transfers serial data and a shift clock to the driver IC 530 to execute printing. The driver IC 530 stores the data transferred in the shift register 531 thereof.

At this moment, the CPU 501 reads at same time the pulse width data of from the first to eighth lines from the pulse width data table stored in the ROM 502 and transfers the same to the counters 1 to 8, respectively. Upon completing printing data transfer to the driver IC 530 for all of the control electrodes, the image processing ASIC 504 stops outputting the serial data and the shift clock, and outputs the latch signal. Thus, the driver IC 530 shifts all of the data from the shift register 531 to the latch circuit 532 to be latched therein.

Subsequently, the CPU 501 causes the counters 1 to 8 to start counting up. Simultaneously, outputs (i.e., control pulses P1 to P8) of the counters 1 to 8 become high (H) and keep the level until the pulse width data previously transferred from the CPU 501 to the counter 511 accords with a number of the clocks.

Figure 14:
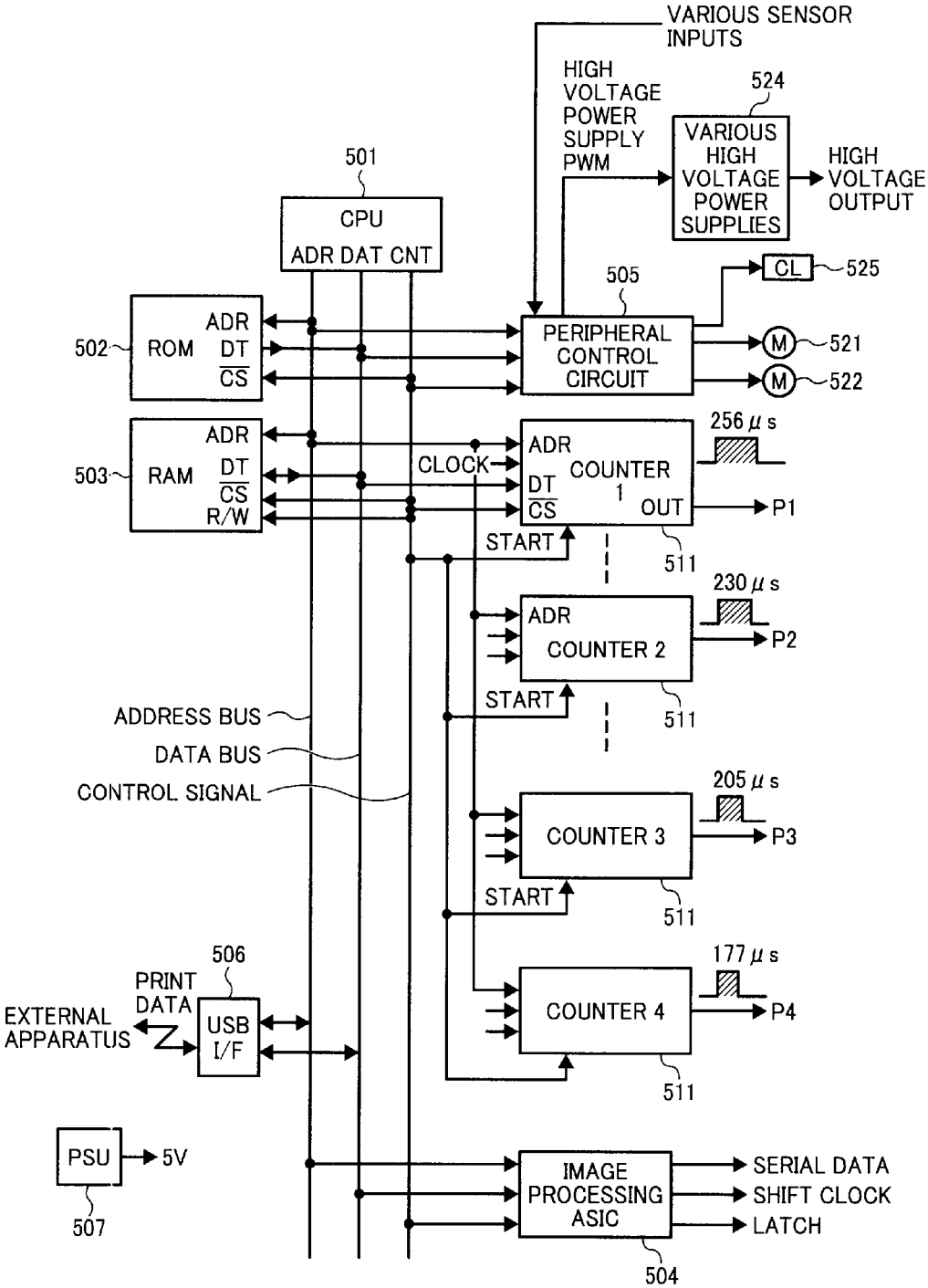
FIG. 14 is a block chart illustrating an exemplary configuration of a control section according to a first example of the present invention.
Figure 15:
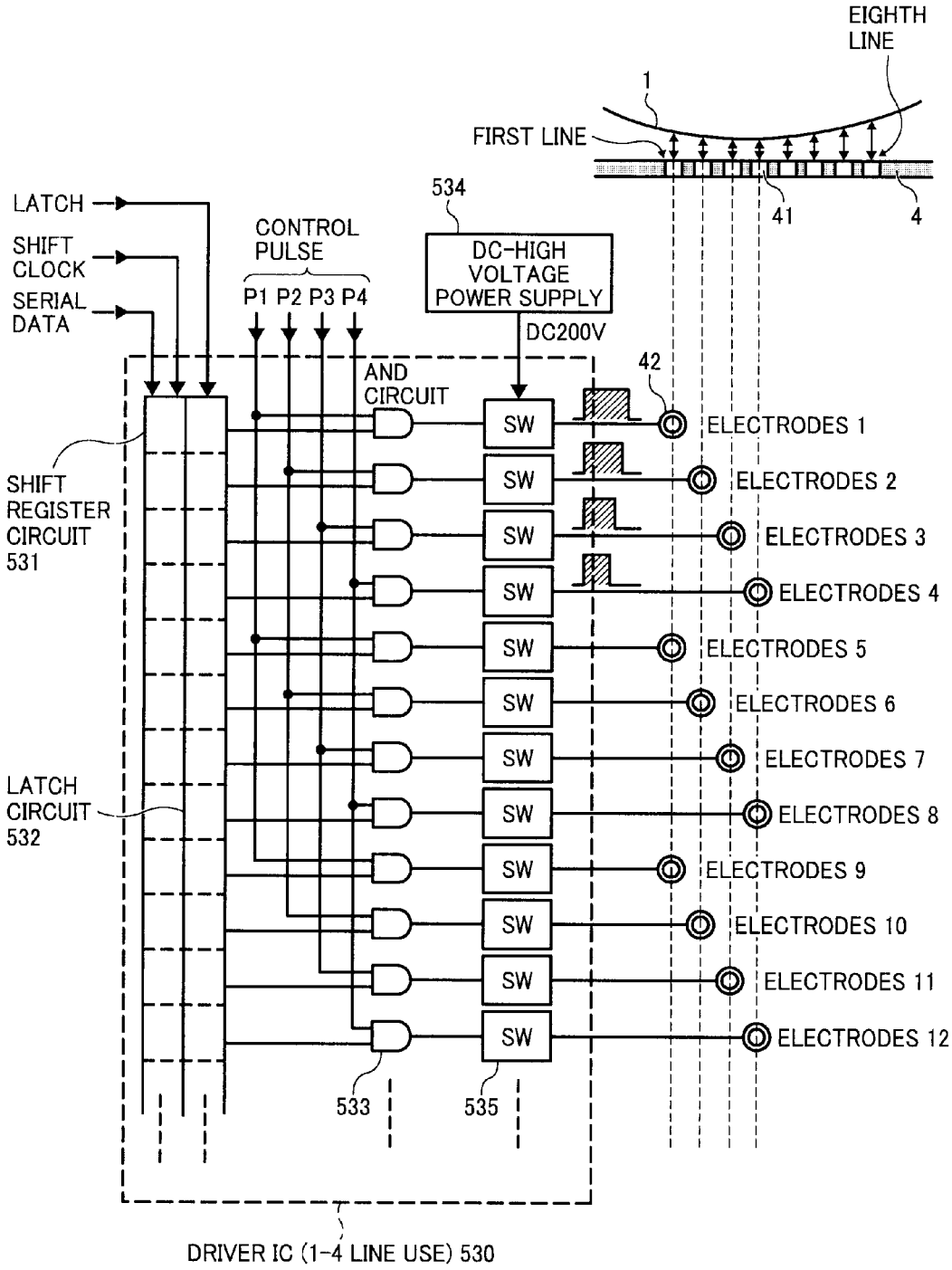
FIG. 15 is a block chart illustrating an exemplary configuration of a driver IC section included in the control section of the present invention.

For example, as shown in FIG. 14, numerals 256, 230, 205, and 177 are set to the counters 1 to 4, respectively. When, the pulse width data accords with the number of clocks, the counters 1 to 8 stop operating and changes the output to a level "L". If one clock is represented by 1 microsecond, widths of the control pulses P1 to P4 are calculated as 256, 230, 205, and 177 microsecond, respectively. These control pulses P1 to P4 are inputted to the driver IC 530 and are subjected to the logical multiplication in the AND circuits 533 with the outputs of the latch circuit 532.

The outputs of the AND circuits 533 are inputted to the high voltage switch circuits 535, and are outputted with an output setting value (e.g. a wave height value 200V) as the high voltage control pulses Vc having pulse widths of the control pulses P1 to P4, respectively. The high voltage control pulses Vc are provided to n number of the control electrodes 41 (i.e., electrodes 1 to n).

In this example, since the electrodes 1, 5, and 9 are included on the first line, their control pulses Vc include 526 microsecond. Similarly, the electrodes belonging to two to fourth lines, their control pulses Vc include 230, 205, and 177 microsecond, respectively. In such a situation, the fifth, sixth, seventh, and eighth lines have the same value as the fourth, third, second, and first lines, respectively.

In this way, in proportion to a decrease amount of toner, a width of the control pulse Vc causing the toner to pass (i.e., toner passage ON condition) becomes longer, and accordingly, the control pulse Vc is applied longer in the first and eighth lines, where the space distance is largest. Specifically, by relatively decreasing the width of the control pulse Vc in the fourth and fifth lines where the space distance is smallest, deterioration of conveyance efficiency of the toner is corrected as a whole. Thus, density change created depending on a position of a control electrode line can be suppressed and a fine image can be obtained. As a result, a high-speed printing can be achieved without decreasing printing speed.

In this way, control pulses having different width, for example, are applied per one or plural lines of toner passage holes on the toner control device to control an amount of toner passing therethrough when clouded toner is moved from the toner bearing member to the printing medium side through the toner passage hole. Thus, the amount of the toner passing through the respective toner passage hole lines in the printing medium moving direction can be equalized. As a result, an image quality can be improved enabling the high-speed printing.

Now, another exemplary pulse width data table including data of a pulse width is described with reference to FIG. 17. In this example, a pulse width of the pulse width data table is changed in accordance with a printing line speed. Specifically, when the printing line speed is decreased to half, the pulse width data generally becomes almost twice, because a time for completely filling a prescribed area with toner takes about twice. However, influence of cloud toner behavior and air resistance of toner decrease, practically, and an amount of the toner increases. Accordingly, as shown in FIG. 17, when the line speed is 168 mm/s on the first line, the pulse width becomes 256 microsecond, where as when the line speed is 84 mm/s, the pulse width becomes 492 microsecond, and is 1, 9 times as being less than twice.

The pulse width for each of the lines is determined as shown in FIG. 18. Specifically, as shown, an exemplary ratio of an amount of toner that passes through a toner passage hole 41 on a line other than the central fourth and fifth lines to that through the toner passage hole 41 on the fourth and fifth lines is calculated and determined. Then, the pulse width provided to each of the lines is changed in accordance with the toner ratio.

Figure 19:
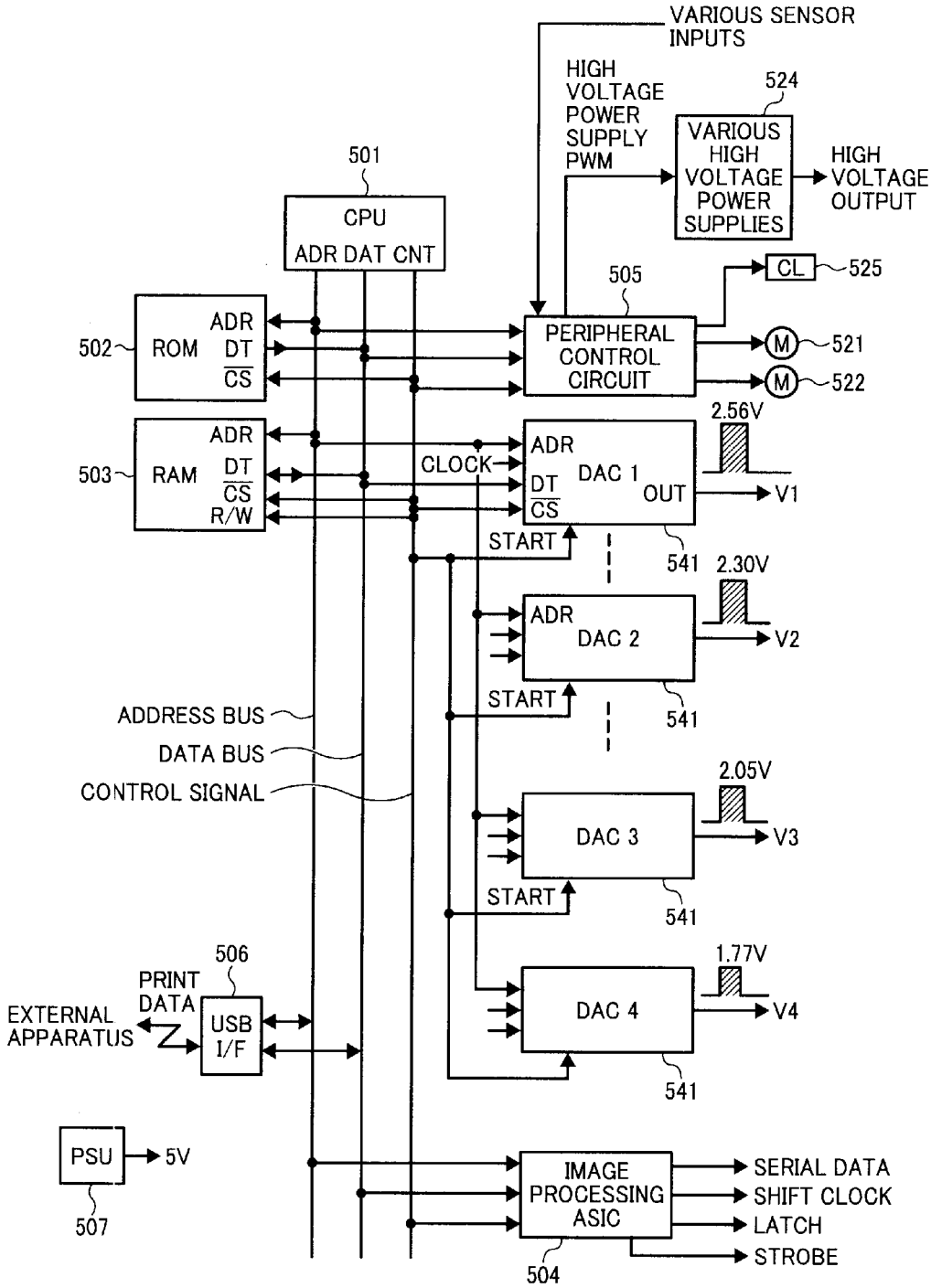
FIG. 19 is a block chart illustrating another exemplary configuration of the control section according to a second example of the present invention.
Figure 20:
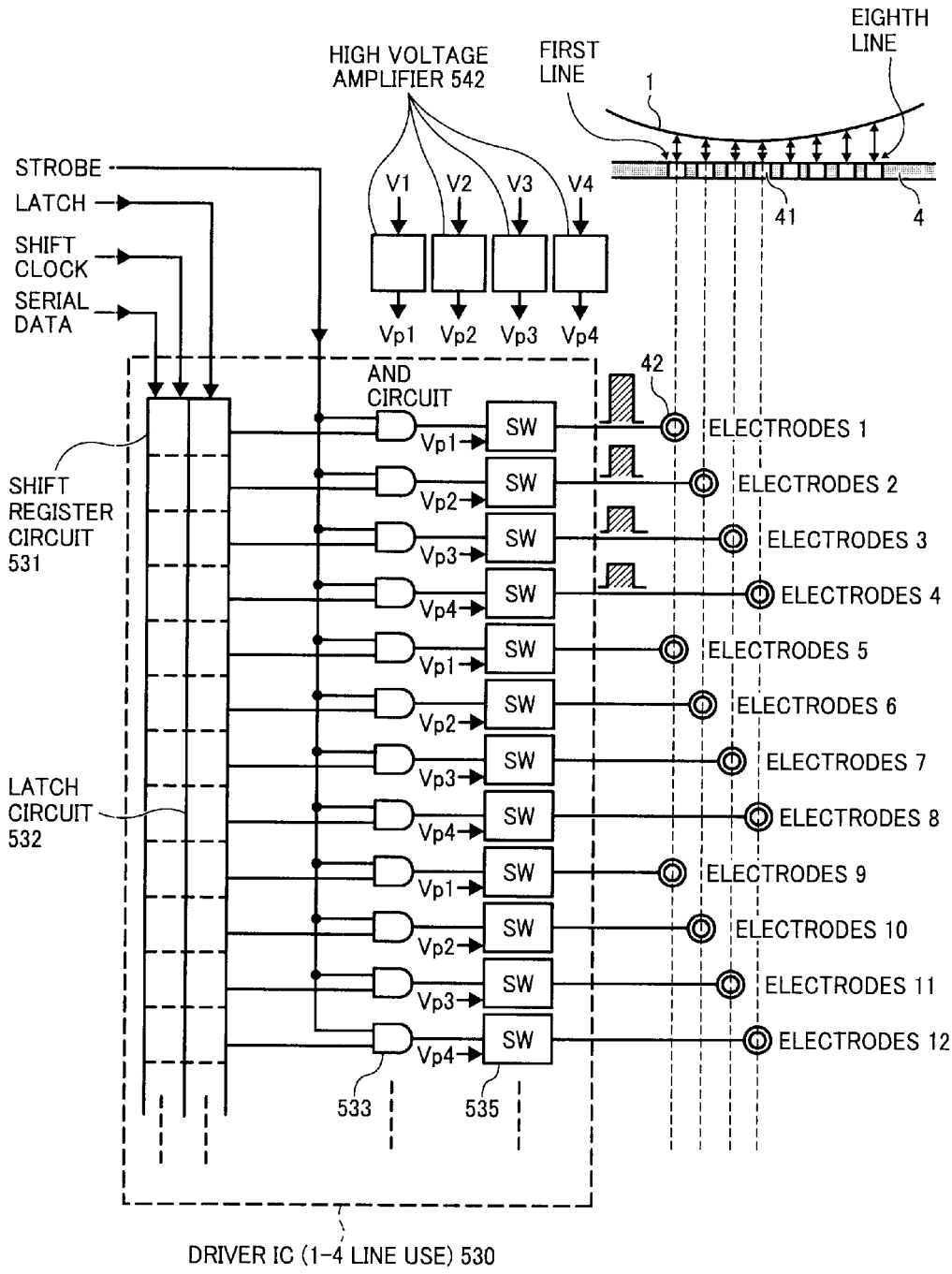
FIG. 20 is a block chart illustrating an exemplary configuration of a driver IC section included in the control section according to the second example of the present invention.
Figures 21, 22, 23:
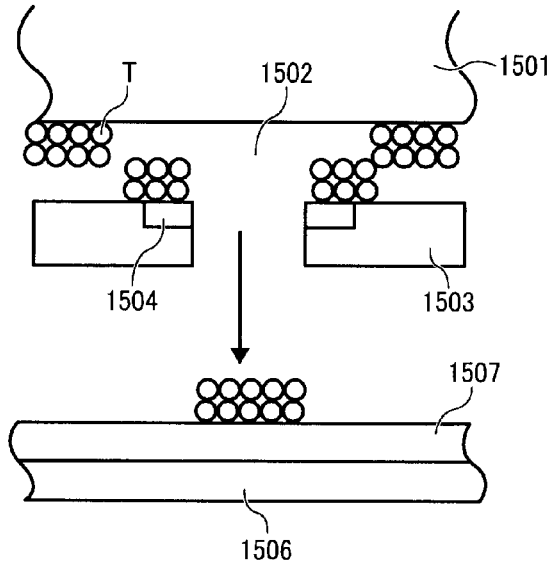
FIG. 21 is a chart illustrating an exemplary wave height data table.
FIG. 22 is a chart illustrating another exemplary wave height data table.
FIG. 23 typically illustrates a fundamental configuration of an apparatus employing a conventional direct printing system.

Now, yet another embodiment is described with reference to FIGS. 19 to 21, in which only the first to fourth lines are illustrated. As shown, a control pulse having a different wave height is provided per one or more lines. To change the wave height, the ROM 502 stores a table listing wave height data of the control pulse corresponding to a line as shown in FIG. 21. Further, instead of the counters of the first embodiment, DACs (i.e., a D/C converter) 541 are provided to apply D/A conversion to wave height data and outputs resulting data of respective control pulse voltages V1 to V8. Further, instead of the DC high voltage power supplies, high voltage amplifiers 542 that receive the control pulse voltages V1 to V8 and output voltages Vp1 to Vp8 each having a prescribed wave height are employed. The outputs voltages Vp1 to Vp8 are then inputted to high voltage switch circuits 535. The high voltage switch circuits 535 receive outputs from the AND circuits 533, each of which is obtained by multiplying a strobe signal from the image processing-ASIC 504 and latch data of the latch circuit 532.

In this example, an amount of toner passing through the toner passage hole 41 is controlled by changing the wave height per line (or prescribed plural lines) while maintaining a pulse width of the control pulse Vc to be a constant value such as 200 ms. Specifically, this example corrects a change of conveyance efficiency of the toner caused by the space distance between the toner-bearing member 1 and the toner passage hole 41.

Now, another exemplary wave height table is described with reference to FIG. 22. As shown, a wave height included in a wave height data table is changed per printing line speed. Specifically, when the printing line speed is decreased to half, the wave height data generally becomes almost twice, because a time for completely filling a prescribed area with toner takes about twice. However, influence of flare behavior and air resistance of toner decreased, and an amount of the toner increases practically.

Instead of the negatively charged toner, positively charge toner can be utilized.

Obviously, numerous additional modifications and variations of the present invention are possible in light of the above teachings. It is therefore to be understood that within the scope of the appended claims, the present invention may be practiced otherwise than as specifically described herein.

ADVANTAGE

According to one embodiment of the present invention, an amount of toner passing through each of the respective toner passage holes arranged in a printing medium moving direction can substantially be equalized while achieving high speed and high quality image formation.

What is claimed is:

1. An image forming apparatus, comprising:

a toner-bearing member configured to bear toner and make the toner clouded thereon;

a toner passage control device including at least two widthwise lines of toner passage holes in a printing medium conveyance direction, each of said toner passage holes including a control electrode configured to control passage of the toner through each of the toner passage holes toward a printing medium; and a control pulse providing device configured to provide a control pulse to the control electrode to operate;

wherein said control pulse applied to the control electrode of the one of the at least two lines is different from that applied to the control electrode of the other one of the at least two lines.

2. The image forming apparatus as claimed in claim 1, wherein said control pulse is different from the other by including at least one of a different pulse width and a different pulse wave height.

3. The image forming apparatus as claimed in claim 1, wherein said control pulse corresponds to a printing line speed.

4. The image forming apparatus as claimed in claim 1, wherein said printing medium includes a printing sheet, further including a sheet opposing electrode arranged on a backside of the printing sheet and configured to receive a bias directing toward the printing sheet.

5. The image forming apparatus as claimed in claim 1, wherein said printing medium includes an intermediate transfer medium, further including a medium opposing electrode arranged on a backside of the intermediate transfer medium and configured to receive a bias directing toward the intermediate transfer medium.

6. The image forming apparatus as claimed in claim 1, further comprising a color image formation device configured to form and overlap toner images of different colors and configured to form a full-color image on the printing medium.

* * * * *